United States Patent [19]

Zuiddam et al.

[11] Patent Number: 4,866,808

[45] Date of Patent: Sep. 19, 1989

[54] ROLLABLE FLOOR MAT

[76] Inventors: Evert Zuiddam; B. J. Zuiddam, both of p/a Gezu Bu/P.O. Box 1010, 3860 BA Nijkerk, Netherlands

[21] Appl. No.: 183,326

[22] Filed: Apr. 7, 1988

Related U.S. Application Data

[63] Continuation of Ser. No. 4,048, Jan. 16, 1987, abandoned.

[51] Int. Cl.[4] ..... A47L 23/26

[52] U.S. Cl. ..... 15/161; 15/217; 52/181; 52/669; 428/85; 428/95; 428/245

[58] Field of Search ..... 15/161, 215–217, 15/237–241, 104.92; 296/1 F; D12/582–586, 592–594; 139/386, 384 R, 420 R, 420 A; 52/177, 181, 664, 669; 428/53, 54, 62, 85, 95, 245

[56] References Cited

U.S. PATENT DOCUMENTS

| | | | |
|---|---|---|---|
| 260,499 | 7/1882 | Pratt | 52/669 |
| 383,132 | 5/1988 | Johnson et al. | 15/239 |
| 1,492,527 | 4/1924 | Morsen | 15/237 |
| 1,799,616 | 4/1931 | Kiefer | 15/215 |
| 1,885,638 | 11/1932 | Steinmetz . | |
| 1,935,517 | 11/1933 | New . | |
| 2,667,654 | 2/1954 | Peterson | 15/238 |
| 2,784,464 | 3/1957 | Larsvall | 15/239 |
| 2,908,027 | 10/1959 | McClung | 15/217 |
| 2,989,766 | 6/1961 | Hoag | 15/217 |
| 3,129,944 | 4/1964 | Amos et al. . | |
| 3,783,471 | 1/1974 | McGeary et al. . | |
| 4,068,339 | 1/1978 | Maruyama et al. | 15/238 |
| 4,244,768 | 1/1981 | Wiechowski et al. . | |
| 4,587,997 | 5/1986 | Brooks | 139/420 R |
| 4,590,110 | 5/1986 | Arens | 15/217 |
| 4,771,586 | 9/1988 | Schmidt | 15/238 |

FOREIGN PATENT DOCUMENTS

| | | | |
|---|---|---|---|
| 705065 | 3/1965 | Canada | 15/217 |
| 2034089 | 1/1972 | Fed. Rep. of Germany | 15/215 |
| 2412151 | 9/1975 | Fed. Rep. of Germany | 52/664 |
| 2805629 | 8/1979 | Fed. Rep. of Germany | 52/664 |
| 1605028 | 12/1981 | United Kingdom | 15/217 |

*Primary Examiner*—Harvey C. Hornsby
*Assistant Examiner*—Joseph S. Machuga
*Attorney, Agent, or Firm*—Finnegan, Henderson, Farabow, Garrett & Dunner

[57] ABSTRACT

An improved rollable floor mat comprising a plurality of substantially U-shaped extruded plastic profiles having straps attached to the underside thereof. The profile has a center portion with a cross-sectional area smaller than the cross-sectional area of the bottom portion of the U-shaped profiles. The bottom surface of the bottom portion of the U-shaped profiles are attached to the plastic straps to form the mat into the desired configuration. The plastic profiles, with bristle-like filaments extending from the top thereof, are flexible in two directions about the smaller cross-sectional aread center portion to provide a scraping action in two directions of the bristle-like filaments to the soles of shoes and boots of persons walking on the mat.

6 Claims, 1 Drawing Sheet

ROLLABLE FLOOR MAT

This application is a continuation of application Ser. No. 044,048, filed Jan. 16, 1987 now abandoned.

BACKGROUND OF THE INVENTION

1. Field of the Invention

The present invention relates to floor mats, and more particularly to a floor mats provided at entranceways to buildings or the like for removing dirt and debris from a person's shoes.

2. Description of the Related Art

Many and varied type of floor mats have been used at the entryways to buildings to protect the appearance and cleanliness of interior spaces of the building. These mats provide a surface on which shoes may be scraped or rubbed to remove dirt or accumulated mud and debris from the shoes prior to entering the building.

Examples of such floor mats are shown in U.S. Pat. No. 3,129,944 and U.S. Pat. No. 3,783,471. These floor mats are basically constructed with a carpet-like top surface and generally must be lifted from the floor in the flat, open state since they have not been specifically constructed to be rollable. U.S. Pat. No. 4,244,768 discloses a rollable industrial grating made of glass fiber, however, the grating does not have a top surface constructed specifically to scrape dirt and debris from a person's footwear.

It is desirable that floor mats for scraping and cleaning mud and debris from a person's footwear possess certain characteristics. First, that the mat resist staining due to the dirt and debris which is rubbed onto the mat while in normal use. Furthermore, when used in an industrial environment in which the mat may be subjected to harsh chemicals or detergents, that the mat resist deterioration when subjected to such chemicals or detergents.

Secondly, it is desirable for such floor mats to provide a firm, anti-slip walking surface so as not to present a risk of injury to someone walking on the mat. While providing such a walking surface on its top most part, it is further desirable that the upper surface of the floor mat be configured to provide a scraping and cleaning action to the bottom surface and lowermost sides of shoes, boots and other footwear of persons walking over the mat.

Finally, the floor mat should be constructed so as to be easily removed to clean the accumulated dirt and debris under the mat or in the mat.

While displaying the characteristics and traits described above, it is still further desirable that the floor mat have a simple construction and utilize easily obtained and inexpensive materials.

While prior art rollable floor mats provide some of the characteristics described above, none provide optimal performance of all of these characteristics.

The invention provides an improved rollable floor mat for use in entryways to buildings or the like which provides optimal scraping action to remove dirt and debris from the bottom surfaces and lowermost sidewalls of shoes and boots of persons walking on the mat.

The invention further provides an improved rollable floor mat having a relatively simple construction using strong, durable materials which resist staining to thereby extend the useful life of the mat.

The invention still further provides a rollable floor mat having a firm, anti-slip surface to walk on.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, a rollable floor mat is provided comprising: a plurality of substantially U-shaped plastic profiles each having a longitudinal channel extending the length thereof. The profiles each have a top, center, and bottom portion, the bottom portion having a first predetermined cross-sectional area, and the center portion having a second predetermined cross-sectional area smaller than the first predetermined cross-sectional area to thereby allow hinged type movement of each U-shaped profile in two directions about the center portion of the profile when pressure is applied to the top portion of the profile. The mat further includes a plurality of bristle-like filaments fixedly positioned in the longitudinal channels of the U-shaped profiles, and a plurality of flexible, non-slip straps attached on the bottom surface of the bottom portion of the U-shaped profiles to bind the profiles substantially perpendicularly relative to the straps.

It is further preferable that the flexible non-slip straps attached on the bottom of the profiles are made of a woven fabric coated with polyvinyl chloride.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention there is provided a rollable floor mat, comprising a plurality of substantially U-shaped plastic profiles each having a longitudinal channel extending the length thereof. The profiles each have a top, center and bottom portion, the bottom portion having a first pedetermined cross-sectional area, and the central portion having a second predetermined cross-sectional area smaller than the first predetermined cross-sectional area to allow hinged-type movement of the U-shaped profiles in two directions about the center portion when pressure is applied to the top surface portion of the profile. The floor mat also includes a plurality of bristle-like filaments fixedly positioned in the longitudinal channels of the U-shaped profiles, and a plurality of flexible non-slip straps attached on the bottom surface of the bottom portion of the U-shaped profiles to bind the profiles substantially perpendicularly relative to the straps.

Figure 1:
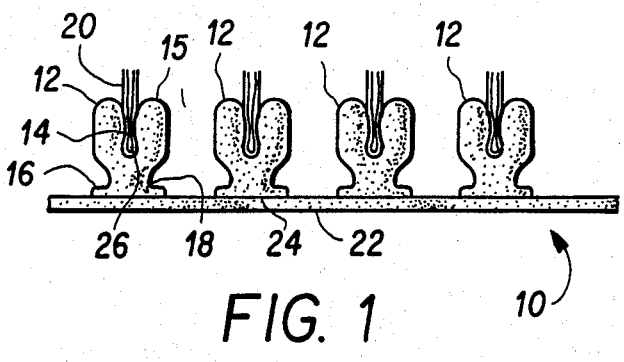
FIG. 1 is a side view of a floor mat incorporating the teachings of the present invention.
Figure 2:
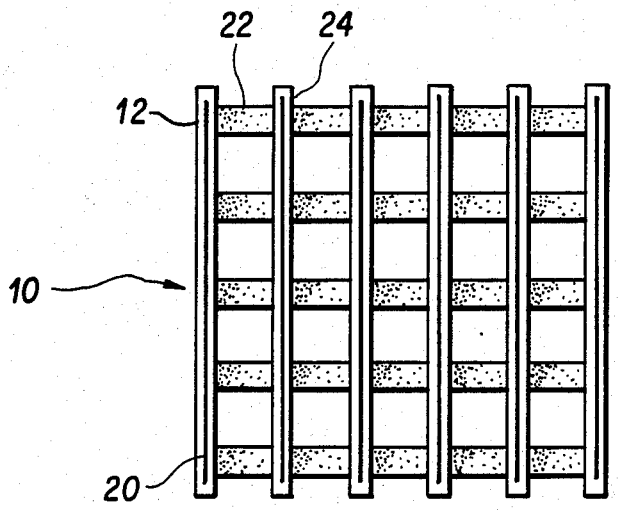
FIG. 2 is a top view of the floor mat illustrated in FIG. 1 and illustrating the construction of a floor mat incorporating the teachings of the present invention.

As shown in FIGS. 1 and 2, a rollable floor mat 10 is provided with a plurality of substantially U-shaped plastic profiles 12. Each profile 12 has a longitudinally extending channel 14 running the length thereof. The profiles 12 have a top portion 15, and a bottom portion 16 which has a first predetermined cross-sectional area, and a center portion 18 which has a second predetermined cross-sectional area which is smaller than the first predetermined cross-sectional area of the bottom portion 16. The smaller center portion 18 of each profile 12 allows the profile to move or hinge about the center portion 18 in two directions when longitudinal and axial forces are applied to the top portion 15 of the profile by a person stepping on the mat.

Each profile 12 has a plurality of bristle-like filaments 20 fixedly positioned in the longitudinal channel 14 of a respective profile 12. When a person steps on the bristle-like filaments 20 longitudinal and axial forces due to the persons weight are applied to the profiles 12. These forces cause each profile to flex and move about the center portion 18 thus moving the filaments 20 in two directions providing a scraper-like action to the soles and lowermost sidewalls of the person's boots or shoes. In this manner, the bristle-like filaments 20 scrape dirt and debris from the boot or shoe of the person stepping on the mat to reduce the amount of dirt and debris that the person tracks into the building.

As seen in FIG. 2, the rollable floor mat 10 includes flexible non-slip straps 22 attached to the bottom surface of the U-shaped profiles 12. Straps 22 are attached to profiles 12 in a substantially perpendicular orientation and act to secure the floor mat 10 in place in the entrance way of the building due to the non-slip characteristics of the straps grabbing and securing the floor mat to the floor of the entranceway. The flexibility of the straps 22 allows the floor mat to be rolled onto itself in the longitudinal direction of the straps 22. Since the floor mat 10 is rollable onto itself in this manner the mat can be easily lifted from the floor to remove the accumulated dirt and debris which would have fallen between the U-shaped profiles 12 due to the two-directional scraper action of the bristle-like filaments 20 on the soles of the person's shoes.

The height and length dimensions of the respective U-shaped profile may be selected for the particular application and the expected types of dirt and debris that the mat will be subjected to. By way of example and non limitation, floor mats incorporating the teachings of the present invention have been constructed with a five millimeter spacing between respective U-shaped profiles.

In the present preferred embodiment of the invention illustrated in FIG. 1, the bristle-like filaments 20 are fixedly positioned in the longitudinal channels 14 of the U-shaped profiles 12 by wrapping the center portion of the filaments about a wire member 26 and inserting the wire member 26 in the U-shaped channel 14 with the distal ends of the bristles extending above the top of the profiles 12 to provide a brush-like scraping surface for the floor mat 10. Wire member 26 is not limited to being constructed of metal and may be made of any suitable material, such as plastic, that allows the filaments to be anchored thereabout. Moreover, the shape of the wire member is not limited to a single configuration and may be made in any shape so as to fit within longitudinal channels 14.

By way of example and non limitation, the U-shaped plastic profiles may be made of a polyvinyl chloride polymer. Specific embodiments of the present invention have been manufactured with such a polyvinyl chloride polymer having a tensile strength of about 450–500 $kgf/cm^2$, an elastic modulus of at least about 25 $kgs/cm^2$, and a resistance to shock of at least about 19 $kgf/cm^2$. Use of a polyvinyl chloride polymer to manufacture the profiles 12 having the above recited physical characteristics has provided excellent results with regard to the durability, firmness, and scraping action of the bristles and profiles. Moreover, the polyvinyl chloride is particularly resistant to stains and the harsh effects of mild corrosives and thus provides a floor mat having superior durability and life-span.

Figure 3:
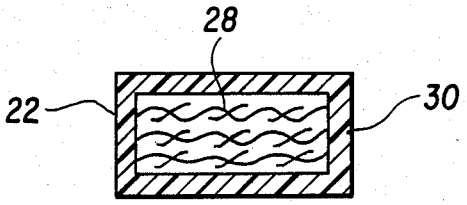
FIG. 3 is a cross-sectional cutaway view of a flexible, non-slip strap used in the embodiment of the floor mat shown in FIG. 1 and FIG. 2.

With reference to FIG. 3, the flexible non-slip straps 22 are preferably configured of a woven fabric 28, such as polyester, with a coating 30 made of plastic, such as polyvinyl chloride, on the outside of the interwoven fabric. In this manner the straps exhibit both flexibility for use when rolling the mat onto itself, and durability due to the strength of the tightly woven fabric and plastic coating. By way of example and not limitation, specific examples of the straps of the instant invention have been fabricated that have a longitudinal tear strength of about 470 N and a braod wise tear strength of about 180 N. Straps 22 exhibiting these physical characteristics have been shown to provide the desired results of flexibility and durability. The plastic coating 30 of the straps 22 is selected to provide sufficient friction against the floor to prevent the mat from slippage, thus securing the mat in its initial position relative to the floor on which it rests.

The floor mat 10 is assembled by placing the U-shaped plastic profiles in substantially parallel rows in a form configured in a predetermined shape corresponding to the desired shape of the mat, the stretching the plastic coated straps substantially perpendicularly across the bottom surfaces of the U-shaped profiles. Next, the plastic coated straps are ultrasonically welded to the bottom surfaces of the U-shaped plastic profiles to cause the plastic coating of the straps and the bottom surface of the plastic profiles to melt. The melted plastic coated straps and the U-shaped plastic profiles are then cooled under pressure to form connections there between where contacting each other.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of applicant's invention.

What is claimed is:

1. A rollable floor mat, comprising:

a plurality of substantially U-shaped plastic profiles each having a longitudinal channel extending the length thereof, said profiles each having a top, center and bottom portion, said bottom portion having a first predetermined cross-sectional area, and said center portion having a second predetermined cross-sectional area smaller than said first predetermined cross-sectional area to allow hinged-type movement of said U-shaped profiles in two directions about said center portion when pressure is applied to said top portion of said profile;

a plurality of bristle-like filaments, having distal end portions, fixedly positioned in said longitudinal channels of said U-shaped profiles such that said distal end portions extend above said top portions of said profiles and flex in said two-directions of hinged-type movement to scrape the surfaces of objects coming in contact therewith;

a plurality of flexible non-slip woven fabric straps attached on the bottom surface of said bottom portion of said U-shaped profiles to bind said profiles substantially perpendicularly relative to said straps.

2. The floor mat of claim 1, further including a center wire inserted in said longitudinal channel of each said U-shaped profile and about which said filaments are wrapped to fix said filaments in said profiles with the distal ends of each said filament extending above the top of said profiles.

3. The floor mat of claim 1, wherein said U-shaped profiles are made of a polyvinyl chloride polymer having a tensile strength of about 450–500 kgf/cm$^2$, an elastic modulus of at least about 25 kgs/cm$^2$, and a resistance to shock of at least about 19 kgf/cm$^2$.

4. The floor mat of claim 1, wherein said flexible non-slip woven fabric straps are coated with polyvinyl chloride.

5. The floor mat of claim 4, wherein said straps have a longitudinal tear-strength of about 470 N and a broadwise tear strength of about 180 N.

6. The floor mat of claim 4, wherein said coated straps are attached to the bottom surface of said bottom portion of said profiles by ultrasonic welding.

* * * * *